United States Patent [19]

Rovera et al.

[11] 4,147,483

[45] Apr. 3, 1979

[54] CLIMBING SHUTTERING FOR CASTING CONCRETE STRUCTURES SUCH AS DAMS OR RETAINING WALLS

[75] Inventors: Mario Rovera, Rivoli; Giuseppe Proverbio, Milan, both of Italy

[73] Assignee: Technical Services Company-Tesco S.p.A., Milan, Italy

[21] Appl. No.: 852,643

[22] Filed: Nov. 18, 1977

[30] Foreign Application Priority Data

Feb. 10, 1977 [IT] Italy ..... 67298 A/77

[51] Int. Cl.[2] ..... E04G 11/28

[52] U.S. Cl. ..... 425/65; 249/20

[58] Field of Search ..... 249/20–22; 264/33, 34; 425/63–65

[56] References Cited

U.S. PATENT DOCUMENTS

| | | | |
|---|---|---|---|
| 2,620,543 | 12/1952 | Scharsach | 425/65 |
| 3,222,750 | 12/1965 | Kimball | 425/65 |
| 3,591,123 | 7/1971 | Edwards | 249/20 |
| 3,628,223 | 12/1971 | Babee | 425/65 |

*Primary Examiner*—Roy Lake
*Assistant Examiner*—John McQuade
*Attorney, Agent, or Firm*—Sughrue, Rothwell, Mion, Zinn and Macpeak

[57] ABSTRACT

A climbing shuttering device comprising a panel or series of panels having a support structure and means for successively raising the panel to define the surface of successive superimposed layers of a cast structure, in which the panel is connected to a main frame linked by an upright member to a lower skid attachable to the hardened lower part of the structure being cast by anchoring elements embedded in the structure during casting. The skid is pivoted to the lower end of the upright member and also connected thereto by a linear actuator the line of action of which is spaced from the pivot so that when the skid is connected to the structure being cast it can tilt the panel, upon operation of the actuator, to swing it right away from the surface of the structure previously cast while it is being elevated to a new position for a subsequent casting stage.

8 Claims, 12 Drawing Figures

S
32
28
30
M
24
26
23
25
126
122
124
113
128
132
120
118
130
38
116
110
134
10
12
114
112

22
54
40
28a
F
58
28b
110
A
106
94
28c
S
M
38
10
23
R4
R3
R2
R1
R0

22
A
E
D
58
106
94
28c
S
23
M
38
10
R3
28b
R2
R1
R0

22
58
106
94
S
M
38
10
23
R3
R2
R1
R0

22
10
58
C
110
106
A
94
M
38
S
B
23
R3
R2
R1
R0

22
54
48
40
28a
58
106
94
28c
M
38
10
S
23
R3
R2
28b
R1
R0

CLIMBING SHUTTERING FOR CASTING CONCRETE STRUCTURES SUCH AS DAMS OR RETAINING WALLS

BACKGROUND OF THE INVENTION

The present invention relates to climbing shuttering for use in casting concrete structures, such as dams and earth supporting walls, which are poured in a plurality of successive layers.

In particular, the invention relates to climbing shuttering of the type having at least one shuttering panel which defines a vertical or inclined surface of part of a concrete structure in the process of being cast, and at least one lifting device connected to the or each shuttering panel, which can be connected to an underlying part of the structure, which has already been cast and hardened, in order to raise the shuttering panel to a suitable position for shuttering the volume above, which is next to be cast.

Known such climbing shuttering comprises at least one shuttering panel for defining a vertical or inclined surface of a part of a structure being cast, and at least one support and elevation device for said at least one panel, said support and elevation device including: a main frame, means connecting said main frame to said panel, first fixing means for removably attaching one of said main frame, said panel, said main frame and said panel to said structure being cast, an upright member longitudinally displaceable with respect to said main frame, second fixing means for removably attaching said upright member to said structure being cast, at a level below said main frame, actuator means interconnecting said main frame and said upright member and operating when actuated to effect relative displacement between said upright member and said main frame, and separation means for displacing said panel toward or away from said structure being cast. In such known climbing shuttering the means for separating the or each shuttering panel from the hardened part of the concrete structure prior to raising the panel or panels consists, for each panel, either of an hydraulic or screw operated actuator having a thrust plate or the like, which is mounted on the shuttering panel and operates to exert a direct thrust on the hardened surface of the concrete structure, or an actuator which interconnects the panel and its associated frame and which operates to exert on the panel a pull towards the frame in order to move it away from the hardened surface of the concrete structure.

Both these known separation means only produce a limited and temporary displacement of the panels from the hardened surface of the concrete structure, for the purpose of breaking the bond formed between the panel and the concrete during hardening, to permit the panel to be raised. During the raising of the shuttering panel there is no certainty that the panel surface facing the concrete will not be scratched against the hardened concrete with consequent wear and scoring damage of the panel. In devices in which the thrust plate of the actuator acts directly on the hardened concrete surface, it is possible to avoid scratching of the panel, but in this case it is the thrust plate or like element of the actuator which is scratched and suffers consequent wear.

OBJECT OF THE INVENTION

The object of the present invention is to provide a climbing shuttering device of the type described, in which scratching of the shuttering panels against the hardened surface of the concrete structure as the panels are raised into position for a subsequent stage of casting of concrete is entirely eliminated.

SUMMARY OF THE INVENTION

According to the present invention there is provided improvements to the known climbing shuttering devices of the type described hereinabove, as a result of which improvements said first fixing means comprise at least first and second connection elements, said first connection element being located adjacent to the upper edge of said panel and including means for permitting said panel to turn about a horizontal axis adjacent the upper edge thereof parallel to said surface of said structure, said second fixing means comprise a skid, pivot means connecting said skid to the lower end of said upright member said pivot means defining a horizontal axis parallel to the surface of said structure being cast, at least one connection element for the removable connection of said skid to said structure being cast, and said separation means comprise actuator means interacting between said skid and said upright member and operable to cause relative angular displacement of said skid and said upright member about said pivotal connection therebetween.

With a climbing shuttering device according to the invention, the separation of the panel from the hardened surface of the concrete structure prior to the raising of the panel itself, is obtained by first releasing the lower part of the panel and the sub-frame, and then operating the separation means in such a manner that the sub-frame turns about its pivot axis on the upright in a direction which moves the upper part of the sub-frame away from the cast concrete structure, whilst a lower part of the sub-frame remains pressed against the surface of the concrete structure. Because the assembly comprising the panel, the main frame and the upright is connected at its upper part to the upper pivoted fixing element or elements, and because this assembly is pivoted to the sub-frame by the rigid upright, this assembly turns about the upper pivoted fixing element in a direction opposite that of the sub-frame so that the panel is displaced away from the surface of the cast concrete structure, contacting it only at its upper part, that is at the said upper fixing element; the contact between the panel and the cast concrete structure is thus broken.

Subsequently, whilst the panel and its main frame are maintained on the structure by only the said pivoted fixing element, the sub-frame is drawn up to a higher level by means of the upright which has associated lifting means which connect it to the main frame. After this, the separation means are made to act in the opposite direction, so that the sub-frame is again brought against the surface of the cast concrete structure. The sub-frame is then fixed to the structure at the higher level to which it has been raised and the upper pivoted fixing element is released.

The separation means are then again energized to move in a direction which causes the whole assembly formed by the panel, the main frame and the upright, to pivot away from the cast structure. The main frame and the panel can then be raised to the new position, by operation of the lifting means, and when they are in this new position the separation means are energized once more in the opposite direction to cause the whole assembly to pivot towards the surface of the cast concrete structure until the panel again contacts the surface of the cast structure, but of course now also projects above this for the production of the next layer or casting of the concrete to form the next part of the structure. In this position, a lower part of the panel is located against the upper part of that layer of the structure which has just been cast and hardened, and the panel is fixed to this by means of its lower fixing element or elements.

Further characteristics and advantages of the invention will become clear from a reading of the following detailed description in which reference is made to the appended diagrammatic drawings which illustrate a preferred embodiment by way of non-restrictive example only.

DESCRIPTION OF THE PREFERRED EMBODIMENT

Figure 1:
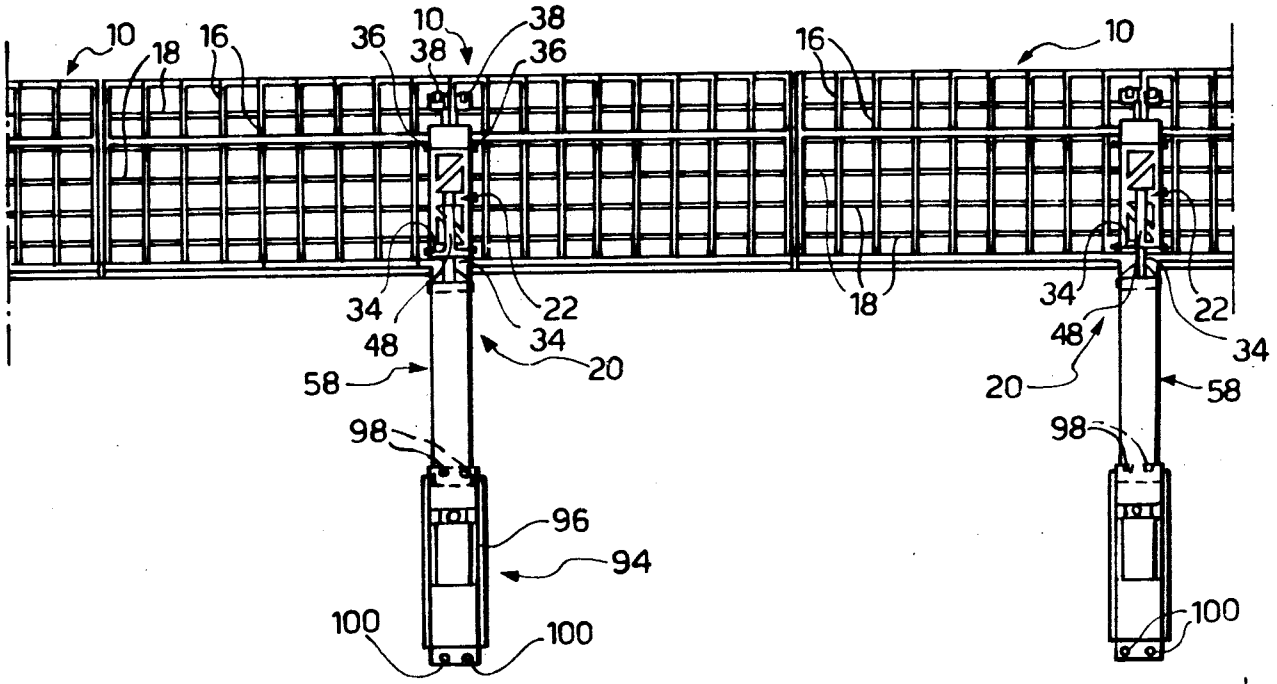
FIGS. 1 and 2 are respectively a front view and a plan view as seen from above of a climbing shuttering device comprising several panels and several lifting devices.
Figure 2:
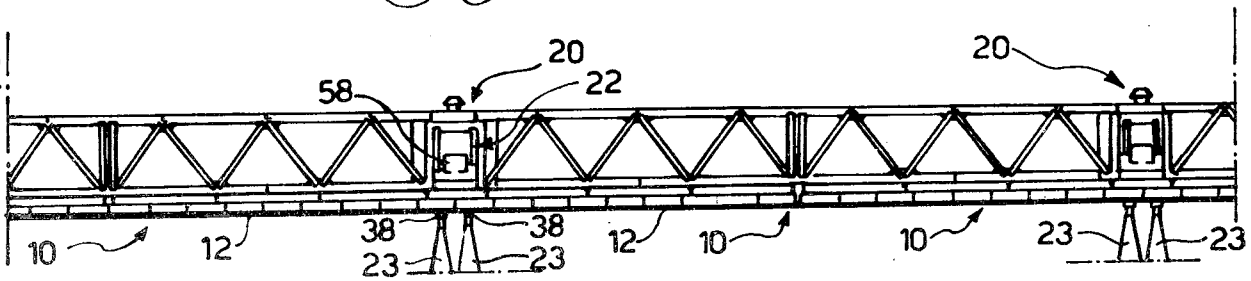

With reference to FIGS. 1 and 2, a climbing shuttering device according to the invention comprises a series of wide rectangular panels 10, interconnected side by side so as to form an extended shutter which runs the whole length of a wall to be cast. Each panel 10 has a substantially flat and smooth front wall 12 which, with the walls 12 of the contiguous panels 10 delimits a continuous surface of part of a concrete structure in the process of being cast. The walls 12 are made of sheet-metal and are reinforced at the back by a framework of vertical ribs 16 and horizontal ribs 18 formed of shaped sections of sheet metal.

Each individual panel 10 has, located on the longitudinal center-line thereof, a lifting device, generally indicated by the reference 20, the details of which will be described hereinafter.

Now reference will be made to FIG. 3, in which a climbing shuttering device as shown in FIGS. 1 and 2 is illustrated in operation during the casting, in successive layers, of a concrete structure M, such as a dam or a wall intended to retain an earth embankment. The structure M has a vertical surface S which the panels 10 are intended to define during the casting of the various layers of the structure.

Figures 4, 5, 12:
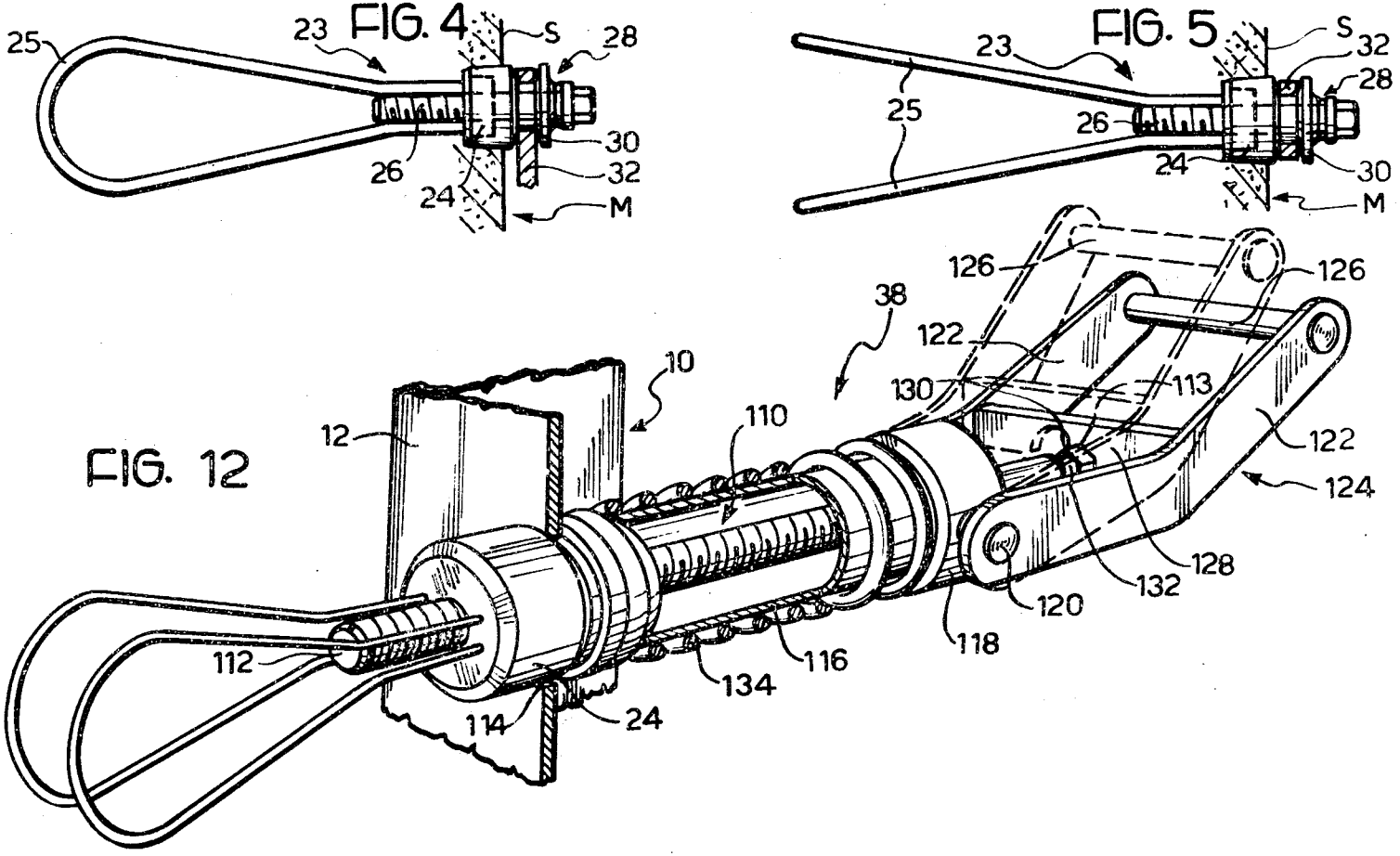
FIGS. 4 and 5 are respectively a side view and a plan view of one of the anchoring devices of the shuttering for fixing the shuttering device to the cast concrete structure, also showing the associated fixing element forming part of the climbing shuttering device of the invention, both on a much enlarged scale with respect to that of FIG. 3.
FIG. 12 is a perspective view, partly broken away, on an enlarged scale with respect to FIG. 3, of one of the upper fixing elements for fixing the upper portions of the panels to the cast concrete structure.
Figure 11:
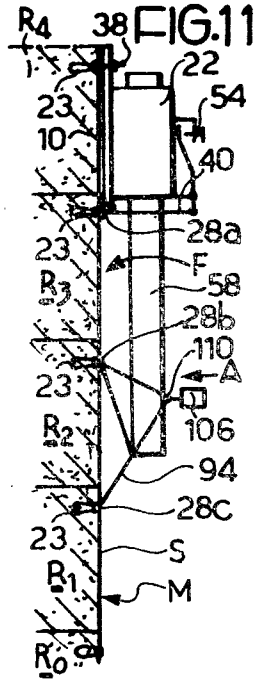
FIGS. 7 to 11 are views similar to FIG. 3, but very diagrammatic which illustrate the successive stages of operation of the climbing shuttering device of the invention.

Although the case of a vertical surface S has been illustrated, it will be understood that climbing shuttering according to the invention can equally well be used in the casting of a structure with an inclined surface. As illustrated in FIG. 3, the existing part of the cast concrete structure M has been formed by casting successive layers R of concrete of substantially the same thickness. In the upper part of each of these layers R, during the casting, an anchoring element 23 has been buried; this anchoring element can advantageously be of the "tail-loop" type such as is illustrated in FIGS. 4 and 5. Such an anchoring element comprises an internally threaded bush 24 which is mounted flush with the surface S of the structure M, and to which are fixed two spread-apart metal wire loops 25, which serve to provide the anchoring of the element to the concrete. Into the threaded bore of the bush 24 can be screwed a threaded shank 26 of a screw fixing element 28 having a collar 30 by means of which a notched or drilled part 32 of one of the elements of the climbing shuttering can be clamped against the outer face of the bush, as will be seen more clearly below. The anchoring elements 23 are embedded in the cast concrete structure M at a regular spacing both horizontally and in the direction of elevation of the climbing shuttering (the vertical direction in the case under consideration).

Figure 3:
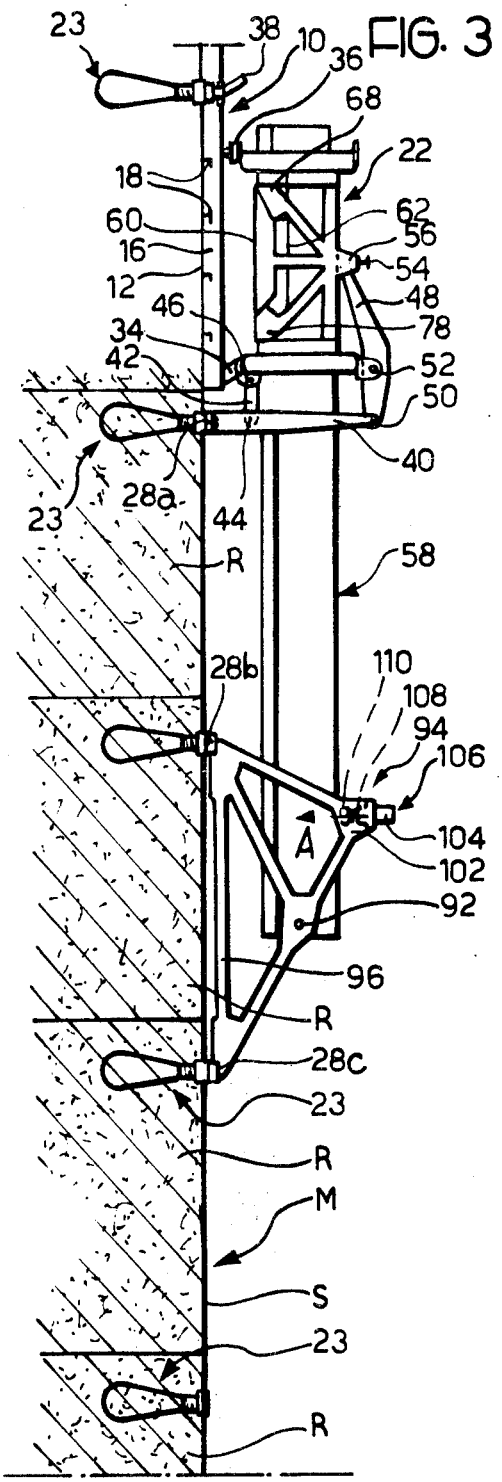
FIG. 3 is a side view, on an enlarged scale, of one of the lifting devices, in which have been shown in vertical section, the upright, the panel and the concrete structure.

With particular reference to FIGS. 1 to 3, the lifting device 20 comprises a main frame 22 in the form of a cage of metal struts which is open at the top and bottom. The lower part of the cage 22 is connected to the panel 10 adjacent the bottom edge thereof by means of a pivot 34 having a horizontal axis parallel to the surface S. The upper part of the cage 22 is connected near the upper part of the panel 10 by means of a pair of adjustable screw couplings 36 the purpose of which is to permit the adjustment of the inclination of the panel 10 with respect to the main frame 22 and therefore with respect to the plane of the surface of the concrete structure formed so far, by turning the panel about the axis of the above mentioned lower pivot.

The upper part of the panel 10 is removably connected to the upper anchoring elements 23 by means of a pair of upper fixing elements 38, one of which is shown in more detail in FIG. 12.

As shown in FIG. 12, each upper fixing element 38 includes a tie rod 110. The tie rod 110 has a threaded end 112 which is screwed into the threaded bush 24 instead of the threaded shank 26 of the aforesaid screw fixing element 28. At the opposite end, the tie rod 110 has a hexagonal head 113.

The tie rod 110 extends loosely through an aperture 114 of the front wall 12 of the panel 10 and through an elongated sleeve 116 which is fixed to the panel 10.

A collar 118 is slidably fitted around the sleeve 116 and has a pair of pivot pins 120 on which there are pivoted a pair of side arms 122 of a handle assembly 124. The side arms 122 are connected together by a handle cross-bar 126 and by an abutment cross-bar 128.

The cross-bar 128 has a central notch 130 which is adapted to receive a reduced portion 132 of the tie rod 110, which portion 132 is adjacent to the head 113.

The sleeve 116 is surrounded by a helical compression spring 134 reacting between the panel 10 and the slidable collar 118.

As it will be understood, with the handle assembly 124 in a position as indicated by continuous lines in FIG. 12, the notch is embracing the reduced portion 132 of the tie rod 110 and the abutment cross-bar 128 is abutting against the head 113. Thus, when the bush 24 is embedded in the cast concrete structure M of FIG. 3, as will be seen below, the upper portion of the panel 10 is firmly, but yieldably held against the surface S of the structure M by the springs as 134 of all the upper fixing elements 38.

In this position of the handle assembly 124, the compression of the spring 134 can be regulated by rotating the head 113 of the tie rod 110 with the aid of a suitable wrench. Such compression can be released by lifting the handle assembly 124 to a position as indicated by broken lines in FIG. 12.

The upper fixing element 38 is thus a yieldable attachment means the purpose of which will be explained fully below.

Returning now to FIGS. 1 to 3, the panel 10 is pressed against the structure during casting by means of a parallelogram linkage including a tension rod 40 which extends substantially perpendicular to the surface S of the structure M and is attached to an anchoring element 23 embedded in hardened concrete by means of a fixing element 28*a* like the element 28 of FIGS. 4 and 5, and a connecting link 42 which connects the tension rod 40 to the lower part of the frame 22 adjacent the panel 10; the connecting link 42 is pivoted at its lower end to an intermediate point of the tension rod 40 by means of a link block coupling 44 which permits movement to allow for the slight differences in spacing between the fixing elements 28*a* and 38 and the corresponding anchoring elements 23 with which they are associated at any one time, and at the upper end is connected by a pivot 46 to the lower part of the main frame 22. The tension rod 40 is also connected to the main frame 22 by means of a lever arm 48, a lower end 50 of which is pivoted to the end of the tension rod 40 remote from the fixing element 28*a*, and an intermediate point 52 of which is pivoted to the lower part of the main frame 22. The upper end of the lever arm 48 is engaged by the free end of a pressure screw 54 which is directed towards the frame 22, and therefore towards the structure M, and is threaded in captive nut in a bracket which is attached securely to the main frame 22. As will be appreciated the, lower strut of the main frame 22 completes the parallelogram linkage so that, when the fixing element 28*a* is coupled to one of the anchoring elements 23, it is possible to keep the lower part of the panel 10 tightly pressed against the surface S of the structure M by means of the pressure of the screw 54 on the corresponding end of the lever arm 48.

In an alternative system (not shown) the frame 22 could be fixed directly to the rear or outer face of the panel 10 and the fixing elements 28*a* and 38 could be mounted either on the panel itself or on the main frame 22.

For symmetry there are preferably provided two parallel tension rods 40 one on each side of the main frame, each provided with a fixing element 28*a* and connected to the lever arm 48 by a transverse bar. In such an arrangement, there would be provided appropriately spaced anchoring elements 23 to which the two fixing elements 28*a* associated, one with each tension rod as well as the two fixing elements 38 can be connected.

Extending through the frame 22 in a vertical direction there is an upright column having a U-shape cross section and made of strong sheet metal; the opening of the U faces towards the structure M. The main frame 22 and the upright column 58 are interconnected by lifting means illustrated in more detail in FIG. 6, which serve to produce the relative lifting movements of the main frame 22 and the upright column 58 by means of which the shuttering device can climb up the surface of the structure M being cast.

Figure 6:
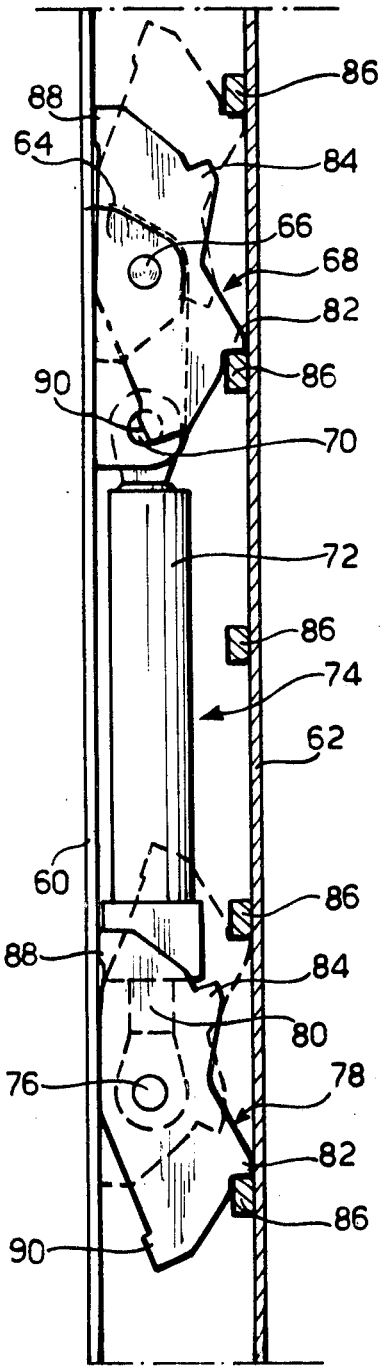
FIG. 6 is a side view, partly in section, on an enlarged scale with respect to FIG. 3, of the lifting means which interconnect the main frame and the upright to produce the lifting movement and the relative locking.

As illustrated more clealy in FIG. 6, the main frame 22 has a substantially vertical wall 60 and the upright column 58 has a substantially vertical wall 62 which lies generally parallel to the wall 60. The two walls 60 and 62 define between them a channel in which is located a ratchet system forming part of the lifting means and comprising a bracket 64 fixed to the frame 22, and to which is pivoted a ratchet pawl 68 on a pivot 66. To the lower end of the bracket 64 there is also pivotally connected, by a pivot 70, the end of a cylinder 72 of a double acting linear hydraulic actuator of the cylinder and piston type, generally indicated 74, which extends downwards in the channel between the two walls 60 and 62. From the actuator cylinder 72 project, downwardly, a piston rod 80 to which is pivotally mounted a second pawl 78 by a pivot 76.

The two pawls 68 and 78 are formed of thick plates of shaped sheet metal identical to one another. Each pawl has a pair of "mirror-image" identical teeth, comprising a lower tooth 82 and an upper tooth 84 which are capable of engaging projections 86 spaced at equidistant intervals along the wall 62 and extending into the channel defined by the two walls 60 and 62. The surface of the wall 60 facing into the channel is smooth and the two pawls 68 and 78 each have an upper edge 88 and a lower edge 90, inclined to the upper edge 88 which abut against the wall 60 in respective positions of of the pawls 68 and 78. The edges 88 and 90, in fact, form a shallow angle relative to one another and are symmetrical with respect to the axis of rotation of the pawls about the pivots 66 and 76.

Each pawl 68 and 78 has associated biasing means, for example resilient biasing means such as a spring (not shown), which can be selectively operated in a well known way so as to cause the pawl to turn in an anticlockwise direction to dispose it in a position as indicated by continuous lines, or in a clockwise direction to dispose it in a position as indicated by the broken lines. When the upright column 58 is held fixed with respect to the structure M the two pawls 68 and 78 are biased to the solid line position as shown in FIG. 6. The actuator 74 is shown in its contracted position and when the actuator 74 is energized to extend the same, the lower end of the piston rod 80 cannot move downwardly due to the engagement of the lower tooth 82 of the pawl 78 with a projection 86 on the wall 62. The cylinder 72 of the actuator 74 is therefore compelled to move upwardly causing the wall 60 and the panel 10 to be raised. During the raising movement of the wall 60 the lower tooth 82 of the pawl 68 will merely ratchet over the projections 86 as the pawl 68 moves upwardly with the cylinder 72. When the actuator 74 is in its expanded position the lower tooth 82 of the pawl 68 will be brought into engagement with the upper surface of a projection 86. The actuator 74 is then energized to contract the same. Since the upper end of the cylinder 72 and the wall 60 cannot move downwardly due to the engagement of the lower tooth 82 of the pawl 68 with the projection 86 on the wall 62, the lower end of the piston rod 80 is compelled to move upwardly. During the raising movement of the piston rod 80 the tooth 82 of the pawl 78 will ratchet over the projections 86 until it reaches the condition shown in FIG. 6 whereupon it engages the upper surface of an adjacent projection 86. Cyclical extending and contracting movements of the actuator 74 will therefore cause the wall 60 and the panel 10 to be raised with respect to the structure M.

When, on the other hand, the wall 60 and the panel 10 are fixed to the structure M the two pawls 68 and 78 are biased to the position indicated by the broken lines in FIG. 6. Cyclical extending and contracting movements of the actuator 74 will thereby cause, in a manner similar to that described above, the raising of the wall 62 and the upright column 58 with respect to the structure M due to the engagement of the upper teeth 84 of the pawls with the lower surfaces of the projections 86.

Referring now to FIGS. 1 to 3, to the lower end of the upright column 58 there is pivotally connected a skid 94 which can turn about a horizontal axis 92 parallel to the surface S. This skid 94 has two strong generally triangular side frames of metal struts, and a sole plate 96 having a pair of upper notches 98 and a pair of lower notches 100. Each of the notches 98 is intended to receive a part of a connection element 28 such as is illustrated in FIGS. 4 and 5, and to engage behind the collar 30 of such element for the purpose of pressing the sole plate 96 tightly against the surface S of the concrete structure M. Naturally the spacing between the upper notches 98 and the lower notches 100 is identical to the vertical spacing between consecutive anchoring elements 23. Any possible small differences in the vertical spacing of the anchoring elements being accommodated since the connection elements 28 are allowed a certain positional variation by the notches.

The connection elements 28 which engage the upper notches 98 have been indicated by the reference **28*b* in FIG. 3, and the connection elements which engage the lower notches 100 have been indicated by the reference 28*c*. When the connection elements 28*b* and 28*c* are tightened, the skid 94 is securely clamped against the surface S of the structure M in the orientation shown in FIG. 3. The apex of the triangular side frames of the skid 94 is situated on the side of the upright column 58 opposite that facing towards the structure M and carries a bracket part 102 to which is fixed a cylinder 104 of a linear fluid pressure actuator 106, preferably of the single acting hydraulic type, the line of action of which is aligned in a direction substantially perpendicular to the surface S, as indicated by the arrow A of FIG. 3**.

The hydraulic actuator 106 has a piston rod to the outer end of which there is connected, by means of a ball joint 108, a shoe 110 for pressing against the corresponding face of the upright 58.

FIGS. 7 to 11 illustrate the successive stages of operation of the climbing shuttering device described above.

Figure 7:
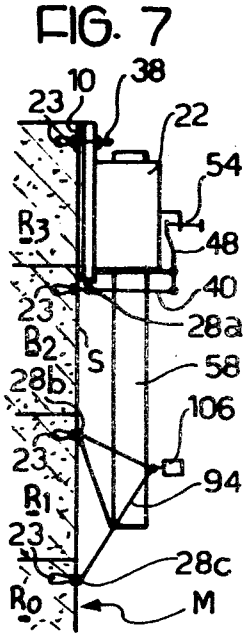

In FIG. 7 the climbing shuttering device is shown in the position which it would occupy immediately after the casting of a concrete layer $R_3$ has been completed. The device is held to the structure M by the connection elements **28*a*, 28*b* and 28*c* which are connected to anchoring elements 23 in those layers $R_0$, $R_1$ and $R_2$ which are already hardened. When the layer $R_3$ has hardened the connection elements 28*b* and 28*c* which hold the sole plate 96 of the skid 94 against the concrete structure M are released, and then the stresses within the shuttering device are relieved by turning the pressure screw 54 to displace the upper end of the lever arm 48 to the right as viewed in the drawings, thereby releasing the tension on the tension rod 40 and the pressure on the lower member of the main frame 22 which pressed the lower part of the panel 10 against the concrete structure M while the upper layer $R_3$ was hardening. Once this tension has been relieved, the connection element 28*a* connecting the tension rod 40 and the previously uppermost anchoring element 23 is released so that the whole of the climbing shuttering device is now suspended on the structure M by means of the connection element 38 which is connected to the new upper anchoring element 23** in the newly hardened layer $R_3$.

The actuator 106 carried by the bracket 102 of the skid 94 is extended to cause relative separation between the apex of the triangular side frames of the skid and the adjacent face of the upright column 58 by means of the pressure exerted by the pressure plate 110 of the actuator 106 against the adjacent side face of the upright column 58. The direction of the force applied by the actuator 106 on the upright column 58 is indicated by the arrow A in FIG. 8. Because the force is applied on the upright column 58 at a point above the pivot 92 between the skid 94 and the upright column 58 the skid 94 rotates in the direction of the arrow B of FIG. 8 so that only the lower end thereof previously connected by the connection element **28*c* to the anchoring element 23 is touching the surface S of the concrete structure M. This rotation of the skid 94 causes the pivot 92 to be displaced away from the surface S of the concrete structure M since the lower connection element 28*c* will press against this surface S, and this has the effect of turning the whole of the climbing shuttering device in an anticlockwise direction as shown by the arrow C of FIG. 8 about the upper edge of the panel 10, which is allowed by the yielding of the compression spring 134 (FIG. 12) of the connection element 38. The bond between the panel 10 and the newly hardened concrete layer $R_3$ is thus broken, the actuator 106** having a considerable leverage in this respect.

Subsequently, in order to raise the skid 94, the actuator 74 is successively expanded and contracted to cause the upright column 58 to be displaced upwardly with respect to the main frame 22 by the ratchet system described in relation to FIG. 6. This continues until the skid 94 has been displaced by a distance equal to the vertical separation between adjacent anchoring elements 23 bringing the notches in the upper edge of the sole plate 96 of the skid 94 into alignment, or at least approximate alignment, with the threaded bush of the anchoring element 23 in the layer $R_2$ where it was previously aligned with the corresponding anchoring element in the layer $R_1$ immediately beneath the layer $R_2$. The actuator 106 is then operated to contract, bringing the apex of the side frames of the skid 94 back to the same relative position with respect to the upright column 58 as they occupied in the initial relative orientation illustrated in FIGS. 3 and 7. The connection elements **28*b* and 28*c* of the skid 94 are then reconnected to the anchoring elements of the layers $R_2$ and $R_1$ respectively so that the skid 94 is clamped to the surface S of the concrete structure M in a manner identical with the original conditions except that it has been elevated by a distance equal to the spacing between adjacent vertically separated connection elements 23. The panel 10** is now again parallel and in contact with the surface of the newly hardened concrete layer $R_3$, but of course the bond between these two has now been broken.

Figure 10:
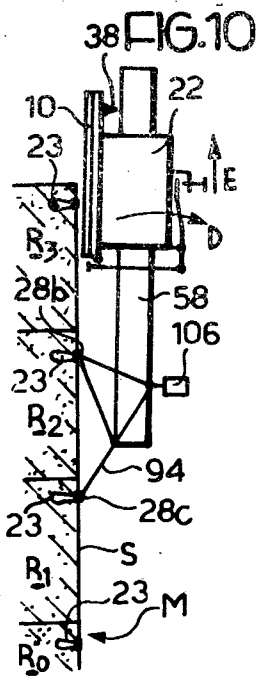
Figure 9:
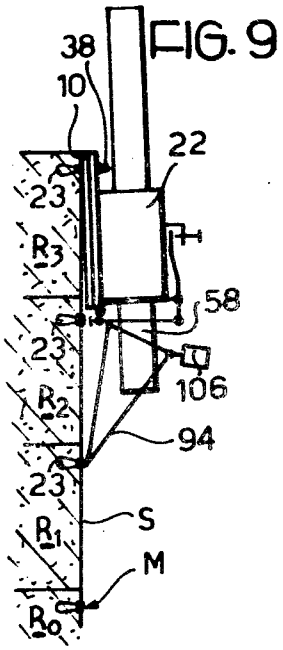
Figure 8:
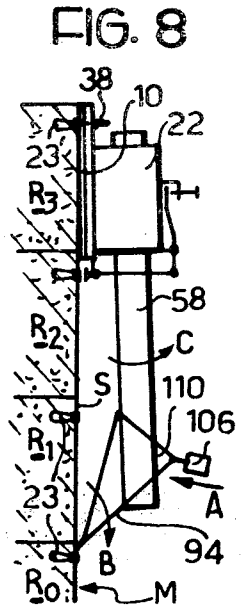

The upper connection element 38 is now disconnected and, with the actuator 106 contracted, the assembly comprising the panel 10, the main frame 22 and the upright column 58 can all turn through a small angle in the direction indicated by the arrow D of FIG. 10 to a position where the panel 10 is slightly spaced from the surface S of the concrete structure M. The pressure plate 110 of the actuator 106 acts as an abutment stop to prevent the above mentioned assembly from turning beyond a given maximum angle which is sufficient to ensure separation of the panel 10 from the surface of the concrete structure M without bringing the centre of gravity of the assembly very far out from its initial position so that no excessive loads are applied to the connection elements 28*b*.

The resilient biasing of the ratchet pawls 68, 78 of the lifting means are then reversed so that upon subsequent contraction and expansion movements of the actuator 74 the main frame 22 is caused to rise with respect to the upright column 58 until it has been displaced by a distance equal to the vertical separation between adjacent anchoring elements 23, in which position the ends of the tension rods 40 which are to be attached by the connection elements 28*a* to the uppermost anchoring element 23 are brought into alignment with this uppermost anchoring element. In this position the actuator 106 is again caused to extend so that its pressure plate 110 applies a force to the upright actuator 58 in the direction of the arrow A of FIG. 11 causing the upright column 58 to turn about the pivotal connection 92 between the column 58 and the skid 94 in the direction of the arrow F of FIG. 11 until the lower edge of the panel 10 is pressed against the upper edge of the newly hardened concrete layer $R_3$. The remainder of the panel 10 projects above the layer $R_3$ by an amount corresponding to the thickness of the new layer $R_4$ to be cast.

The pressure screw 54 is again tightened to cause the upper end of the lever 48 to be moved to the left with respect to the main frame 22 thereby applying a tension to the tension rod 40 and a corresponding compression to the lower frame element of the main frame 22 whereby to press the lower edge of the panel 10 firmly against the upper edge of the concrete layer $R_3$. If necessary, before this tightening of the screw 54 is effected, the vertical inclination of the panel 10 with respect to the main frame 22 is adjusted by means of the screw coupling 36 (see FIG. 3).

Finally, before casting the new layer $R_4$, a new anchoring element 23 is attached to the upper connection element 38 of the panel 10 so that this anchoring element will be buried in the concrete of the new layer $R_4$ when it is cast. After the new concrete layer $R_4$ has been cast and hardened the climbing shuttering device is once again in the position illustrated in FIG. 7, but raised by one step and the process described above is repeated until the concrete structure M has reached the required height.

What is claimed is:

1. In a climbing shuttering device of the type comprising:

at least one shuttering panel for defining a vertical or inclined surface of a part of a structure being cast, and at least one support and elevation device for said at least one panel, said support and elevation device including:

a main frame, means connecting said main frame to said panel, first fixing means for removably attaching said main frame and said panel to said structure being cast, an upright member longitudinally displaceable with respect to said main frame, second fixing means for removably attaching said upright member to said structure being cast, at a level below said main frame, first actuator means interconnecting said main frame and said upright member and operating when actuated to effect relative displacement between said upright member and said main frame, and separation means for displacing said panel toward or away from said structure being cast, the improvement wherein:

said first fixing means comprise at least first and second connection elements, said first connection element being located adjacent to the upper edge of said panel and including means for permitting said panel to turn about a horizontal axis adjacent the upper edge thereof parallel to the said surface of said structure;

said second fixing means comprise a skid, pivot means connecting said skid to the lower end of said upright member, said pivot means defining a horizontal axis parallel to the surface of said structure being cast, and at least one connection element for the removable connection of said skid to said structure being cast; and said separation means comprise second actuator means interacting between said skid and said upright member and operable to cause relative angular displacement of said skid and said upright member about said pivotal connection therebetween.

2. A climbing shuttering device as in claim 1, wherein said second actuator means include a linear actuator carried by said skid at a position located on the side of said upright member opposite that facing said structure being cast, said linear actuator having a thrust element acting on said upright member whereby to apply a force thereto along a line substantially perpendicular to the surface of said structure being cast, this line being located between said main frame and said pivot means connecting said skid to said upright member.

3. A climbing shuttering device as in claim 2, wherein said linear actuator is an hydraulic actuator having a cylinder and a piston and there are means supporting said cylinder on said skid, said piston carrying at its end said thrust element.

4. A climbing shuttering device as in claim 3, wherein said thrust element comprises a pressure plate engageable with the upright and connected to said piston of said linear actuator by a ball joint.

5. A climbing shuttering device as in claim 1, wherein said second connection element of said first fixing means is connected to a tension rod extending substantially perpendicular to the plane of said panel and connected to said main frame by a parallelogram linkage two opposite sides of which are respectively formed by said main frame and said tension rod and the two other opposite sides of which comprise respectively, a connecting rod pivoted at one end to an intermediate point of said tension rod and at the other end to said main frame, and a lever arm pivoted at one end to the end of said tension rod remote from said connecting rod and at an intermediate point to said main frame on the side thereof remote from said panel;

pressure applying means engaging the free end of said lever arm remote from said one end thereof, said pressure applying means comprising a pressure screw threadedly engaged in a fixed element carried on said main frame, rotation of said pressure screw causing displacement of said free end of said lever arm to apply or release tension on said tension rod thereby pressing a lower part of said panel against said structure being cast, or releasing such pressure, in dependence on the direction in which said pressure screw is turned.

6. A climbing shuttering device as in claim 1, wherein said first connection element of said first fixing means is carried on said panel, and said means connecting said main frame to said panel comprise:

a pivotal connection permitting relative angular displacement of said main frame and said panel about a horizontal axis parallel to the plane of said panel and adjacent the lower edge thereof and, an adjustable screw coupling permitting the adjustment of the angular position of said panel with respect to said main frame.

7. A climbing shuttering device as in claim 1, wherein said first connection element of said first fixing means comprises at least one tie rod passing through an opening in said panel and having a threaded end part engageable with a corresponding threaded anchoring element to be embedded in the structure being cast, and an opposite end part projecting from the panel, said projecting end part being biased by a compression spring away from said structure being cast.

8. A climbing shuttering device as in claim 1, wherein said first actuator means interconnecting said main frame and said upright member is a double acting linear fluid pressure actuator of the piston and cylinder type having connected thereto a ratchet mechanism comprising first and second pivoted pawls, the first connected to the cylinder and the second connected to the piston, one of said pawls being also mounted on one of said main frame and said upright member with the other of said main frame and said upright member having a series of projections engageable by said pawls, said pawls being selectively moveable in such a manner as to engage said projections from above or from below so as to cause, by means of the repeated contraction and extension movements of said first actuator means, an incremental relative displacement of said upright member and said main frame whereby to effect raising of one of said main frame and said upright member when the other of said main frame and said upright member is fixed to the structure being cast.

* * * * *